US005245969A

United States Patent [19]

Nishiyama et al.

[11] Patent Number: 5,245,969

[45] Date of Patent: Sep. 21, 1993

[54] ENGINE CONTROL DEVICE AND CONTROL METHOD THEREOF

[75] Inventors: Ryoji Nishiyama; Hideaki Katashiba, both of Hyogo, Japan

[73] Assignee: Mitsubishi Denki K.K., Tokyo, Japan

[21] Appl. No.: 971,582

[22] Filed: Nov. 5, 1992

[30] Foreign Application Priority Data

Nov. 6, 1991 [JP] Japan ..... 3-289781

[51] Int. Cl.[5] ..... F02P 5/10; F02D 41/10

[52] U.S. Cl. ..... 123/422; 123/423; 123/425; 123/435

[58] Field of Search ..... 123/422, 423, 425, 435, 123/492, 493

[56] References Cited

U.S. PATENT DOCUMENTS

| | | | |
|---|---|---|---|
| 4,448,163 | 5/1984 | Yoshida | 123/422 |
| 4,658,789 | 4/1987 | Morita | 123/422 |
| 4,766,545 | 8/1988 | Nagai | 123/422 |
| 4,875,450 | 10/1989 | Yoshikawa et al. | 123/422 X |
| 4,913,118 | 4/1990 | Watanabe | 123/435 |
| 4,971,009 | 11/1990 | Washino et al. | 123/435 |
| 4,996,960 | 3/1991 | Nishiyama et al. | 123/435 |
| 5,027,773 | 7/1991 | Shimomura et al. | 123/422 X |
| 5,107,813 | 4/1992 | Inoue et al. | 123/435 X |
| 5,107,814 | 4/1992 | Nishiyama et al. | 123/435 |
| 5,116,356 | 5/1992 | Ohkubo et al. | 123/435 X |

FOREIGN PATENT DOCUMENTS

| | | |
|---|---|---|
| 59-103965 | 6/1984 | Japan . |
| 59-221433 | 12/1984 | Japan . |
| 60-47836 | 3/1985 | Japan . |
| 1-142228 | 6/1989 | Japan . |
| 1-253543 | 10/1989 | Japan . |

*Primary Examiner*—Willis R. Wolfe

*Attorney, Agent, or Firm*—Sughrue, Mion, Zinn, Macpeak & Seas

[57] ABSTRACT

An object of the present invention is to provide an engine control device and an engine control method which can detect air quantities charged into the cylinders of the engine without delay, and the fuel injection quantity and ignition timing of the engine can be controlled with high accuracy. According to the present invention, when an engine is in steady state, charging efficiency calculating means calculates a fundamental charging efficiency for the suction air quantity of the engine from the difference between cylinder pressures which are detected in synchronization with two predetermined crank angles on the compression stroke, cylinder pressure sensors measure at least one cylinder pressure in synchronization with a crank angle on a suction stroke, averaging means averages cylinder pressures measured on the suction stroke, to provide an average value, correcting charging efficiency calculating means calculates a correcting charging efficiency from the variation in the variation of the average value averaging means in a predetermined period of time, and when the variation is equal to or larger a predetermined value, control means operates to correct the fuel injection quantity and ignition timing of the engine according to the value which is obtained by adding the correcting charging efficiency to the fundamental charging efficiency. The fuel injection quantity, the air/fuel ratio, and the ignition timing of the engine can be controlled with high accuracy.

2 Claims, 5 Drawing Sheets

ENGINE CONTROL DEVICE AND CONTROL METHOD THEREOF

BACKGROUND OF THE INVENTION

This invention relates to an engine control device, and an engine control method which calculates a fuel injection quantity and ignition timing from a pressure in a combustion chamber at the time of acceleration or deceleration, to control the fuel injection quantity and the ignition timing.

FIG. 5 is a diagram showing the arrangement of a conventional engine control device disclosed by Unexamined Japanese Patent Application No. 253543/1989. In FIG. 5, reference numeral 61 designates an engine body. In the cylinder head 61*a* of the engine body 61, a sensor 62 for detecting a pressure in a cylinder (hereinafter referred to as "a cylinder pressure sensor 62", when applicable) and a sensor 63 for detecting a temperature in a Cylinder (hereinafter referred to as "a cylinder temperature sensor 63", when applicable) are provided for each of the cylinders. The cylinder pressure sensor 62 and the cylinder temperature sensor 63 have detecting parts which are exposed in the combustion chamber of the cylinder.

Injectors 64 are provided in suction ports 61*b* communicated the cylinders of the engine body 61. The suction ports 61*b* are communicated through a suction manifold 65 having a throttle chamber 66.

The upstream portion of the throttle chamber 66 is communicated through a suction pipe 67 to an air cleaner 68.

A timing sensor (or crank angle sensor) 610 for detecting crank angles preset for the cylinders is coupled to a distributor 691 which is coupled to a cam shaft (not shown).

On the other hand, an air/fuel ratio sensor 611 is provided at the junction of branch pipes of an exhaust manifold 69 which is communicated with exhaust ports 61*c* of the engine body 61. Further in FIG. 5, reference numeral 612 designates a catalytic converter; and 613, a throttle valve.

Further in FIG. 5, reference numeral 614 designates a control unit (hereinafter referred to merely as "an ECU", when applicable) which is made up of a microcomputer including a CPU, RAM, ROM, input interface, etc. The input side of the ECU 614 is connected to the above-described cylinder pressure sensors 61, cylinder temperature sensors 63, timing sensor 610, and air/fuel ratio sensor 611.

The output side of the ECU 614 is connected through a drive circuit 615 to the injectors 64. Further in FIG. 5, reference numeral 615 designates ignition plugs, which are held by the cylinder head 61*a*. The output side of the ECU 614 is further connected through a drive circuit 617 to the ignition plugs 615.

The operation of the conventional engine control device thus organized will be described. The ECU 614 calculates a suction air quantity $G_a$ of each of the cylinders, for instance, according to the following Equation (1):

$$G_a=(P\times V)/(R\times T) \quad (1)$$

where P is the pressure in each cylinder (hereinafter referred to as "a cylinder pressure", when applicable) which the ECU 614 measures in synchronization with a crank angle (for instance BTDC 90°CA (hereinafter a crank angle will be referred to as "°CA", when applicable)) predetermined for the cylinder which crank angle is detected by the timing sensor 610, V is the volume of the combustion chamber at the predetermined crank angle, R is the gas constant in the stroke of compression, and T is the temperature of the gas in the cylinder which is measured with the cylinder temperature sensor (hereinafter referred to as "a cylinder temperature", when applicable).

On the other hand, Japanese Patent Application No. 221433/1984 has revealed the following fact: It is assumed that the cylinder pressure provided at bottom dead center (BDC) on the compression stroke differs by ΔP from the cylinder pressure at 40°CA before top dead center (TDC) as shown in FIG. 6. In this case, there is established a linear relationship between the quantity of air $G_a$ charged into the engine and the cylinder pressure difference ΔP as shown in FIG. 7. Thus, the suction air quantity can be calculated from the difference ΔP between cylinder pressures provided at two crank angles on the compression stroke.

On the other hand, Unexamined Japanese Patent Application No. 47836/1985 has disclosed the following method: Fuel injection times are obtained from a two-dimensional map of fuel injection times which is stored in the ROM of the ECU with the cylinder pressure differences ΔP and engine speeds N as parameters.

The quantity of air $G_a$ charged in the engine is calculated by the ECU 614. By using the quantity of air $G_a$ thus calculated, a fuel injection pulse width $T_I$ is calculated according to the following Equation (2):

$$T_i=K\times G_a\times K_{FB}\times K_e \quad (2)$$

where K is the air/fuel ratio constant; $K_{FB}$ is the air/fuel ratio feedback correction data; and $K_e$ is the correcting coefficient used for correcting the fuel injection pulse width according to the outputs of the cylinder temperature sensor and a cooling water temperature sensor. In response to the fuel injection pulse width thus calculated, the ECU 614 supplies a drive signal to the drive circuit 616, to drive the injectors 64 thereby to control the air/fuel ratio.

On the other hand, Unexamined Japanese Patent Application No. 103965/1984 has disclosed the following technique: The absolute value of a cylinder pressure as shown in FIG. 7 is measured at 40°CA after bottom dead center, and the ECU 614 determines ignition timing referring to a predetermined two-dimensional map of ignition timing for each operating condition which is determined from cylinder pressures and engine speeds, and applies a drive signal to the drive circuit 617, to drive the ignition coils thereby to control the ignition timing.

Unexamined Japanese Patent Application No. 142228/1989 has proposed an engine control device which operates as follows: A suction air quantity is detected from a cylinder pressure or the rate of change of the cylinder pressure in the first half of the suction stroke, and the fuel injection is carried out in the second half of the suction stroke according to the suction air quantity thus detected.

The conventional engine control device is designed as described above. That is, the cylinder pressure value detected on a compression stroke is utilized. For this purpose, the quantity of air sucked into the cylinder is detected, and an air quantity detecting operation is delayed as much. Thus, when the engine is in transient state, the control of the air/fuel ratio and the ignition timing is lowered in accuracy. This is an essential problem to be solved for the device.

The conventional engine control device in which a suction air quantity is detected from a cylinder pressure or the rate of change of the cylinder pressure in the first half of the suction stroke suffers essentially from the following problems: When noises or the gain of the cylinder pressure sensor changes, a cylinder pressure P at a predetermined crank angle, or the cylinder pressure value detected on the suction stroke is affected by spitting or blow-by depending on pulse timing, and is lowered in accuracy because of the limitation in dynamic range of the cylinder pressure sensor. Thus, although the delay in detection of an air quantity is short, when the engine is in steady state the detection of a quantity of air charged in the engine is lowered in accuracy, with the result that the control of the air/fuel ratio and the ignition timing is lowered in accuracy.

SUMMARY OF THE INVENTION

Accordingly, an object of this invention is to eliminate the above-described difficulties accompanying a conventional engine control device. More specifically, an object of the invention is to provide an engine control device, and an engine control method which detects a quantify of air without delay which is charged into each of the cylinders, and controls the fuel injection quantity and the ignition timing with high accuracy not only when the engine is in steady state but also when it is in transient state, with the result that the air/fuel ration and the ignition timing are accurately controlled with no delay.

An aspect of the present invention, there is provided that an engine control device of the invention, comprises: cylinder pressure difference measuring means for measuring an engine cylinder pressure difference in synchronization with two predetermined crank angles on a compression stroke; charging efficiency calculating means for calculating a fundamental charging efficiency for a suction air quantity of the engine from the cylinder pressure difference thus calculated; cylinder pressure measuring means for measuring at least one cylinder pressure in synchronization with a crank angle on a suction stroke; averaging means for averaging cylinder pressures measured on the suction stroke; correcting charging efficiency calculating means for calculating a correcting charging efficiency from the variation in the output value of the averaging means in a predetermined period of time; transient state determining means for detecting operating conditions of the engine, to determine that the engine is in transient state; and control means for correcting the fuel injection quantity and ignition timing of the engine according to the correcting charging efficiency.

In an engine control method of the present invention, an engine control method comprises the steps of: detecting combustion chamber pressures of a multiple cylinder engine by cylinder pressure sensors; generating a cylinder identifying signal and a crank angle signal in synchronization with rotation of said multiple cylinder engine by a crank angle sensor; measuring combustion chamber pressures of said multiple cylinder engine on a compression stroke, in synchronization with said crank angle signal by first pressure measuring means; calculating a fundamental charging efficiency of said multiple cylinder engine according to said combustion chamber pressures which is measured by said first pressure measuring means by charging efficiency calculating means; detecting a state of said multiple cylinder engine is in acceleration or in deceleration state from at least one of outputs of said cylinder pressure sensors and a throttle opening sensor by state detecting means; measuring at least one combustion chamber pressure in synchronization with a crank angle on a suction stroke by second pressure measuring means; averaging combustion chamber pressures measured by said second pressure measuring means, to provide an average value by averaging means; calculating a correcting charging efficiency according to a variation in said average value provided by said averaging means in a predetermined period of time by correcting charging efficiency calculating means; and correcting a fuel injection quantity and ignition timing of said multiple cylinder engine according to said correcting charging efficiency when said state detecting means detects whether said multiple cylinder engine is in acceleration state or in deceleration state by control means.

The engine control device of the present invention, when the engine is in steady state, the fundamental charging efficiency for the suction air quantity of the engine is calculated according to the difference between cylinder pressures detected in synchronization with two predetermined crank angles on the compression stroke, and the control means controls the fuel injection quantity and the ignition timing according to the fundamental charging efficiency.

On the other hand, cylinder pressures on the suction stroke are averaged to obtain an average value, and the correcting charging efficiency is calculated from the variation in the average value in the predetermined period of time. When it is determined that the engine is in transient state, the fundamental charging efficiency is corrected by using the correcting charging efficiency, and the fuel injection quantity and the ignition timing are controlled according to the fundamental charging efficiency thus corrected.

In the engine control method of the present invention, the cylinder pressure difference measuring means measures the difference between engine cylinder pressures in synchronization with two predetermined crank angles on the compression stroke, the charging efficiency calculating means calculates the fundamental charging efficiency for the suction air quantity of the engine according to the cylinder pressure difference thus measured, the cylinder pressure measuring means measure at least one cylinder pressure in synchronization with a crank angle on the suction stroke, the averaging means averages the cylinder pressures thus measured to provide an average value, the correcting charging efficiency calculating means calculates the correcting charging efficiency according to the variation in the average value in the predetermined period of time, and the control means corrects the fuel injection quantity and the ignition timing by using the correcting charging efficiency thus calculated.

DETAILED DESCRIPTION OF THE PREFERRED EMBODIMENTS

One embodiment of this invention, an engine control device and an engine control method, will be described with reference to the accompanying drawings.

Figure 1:
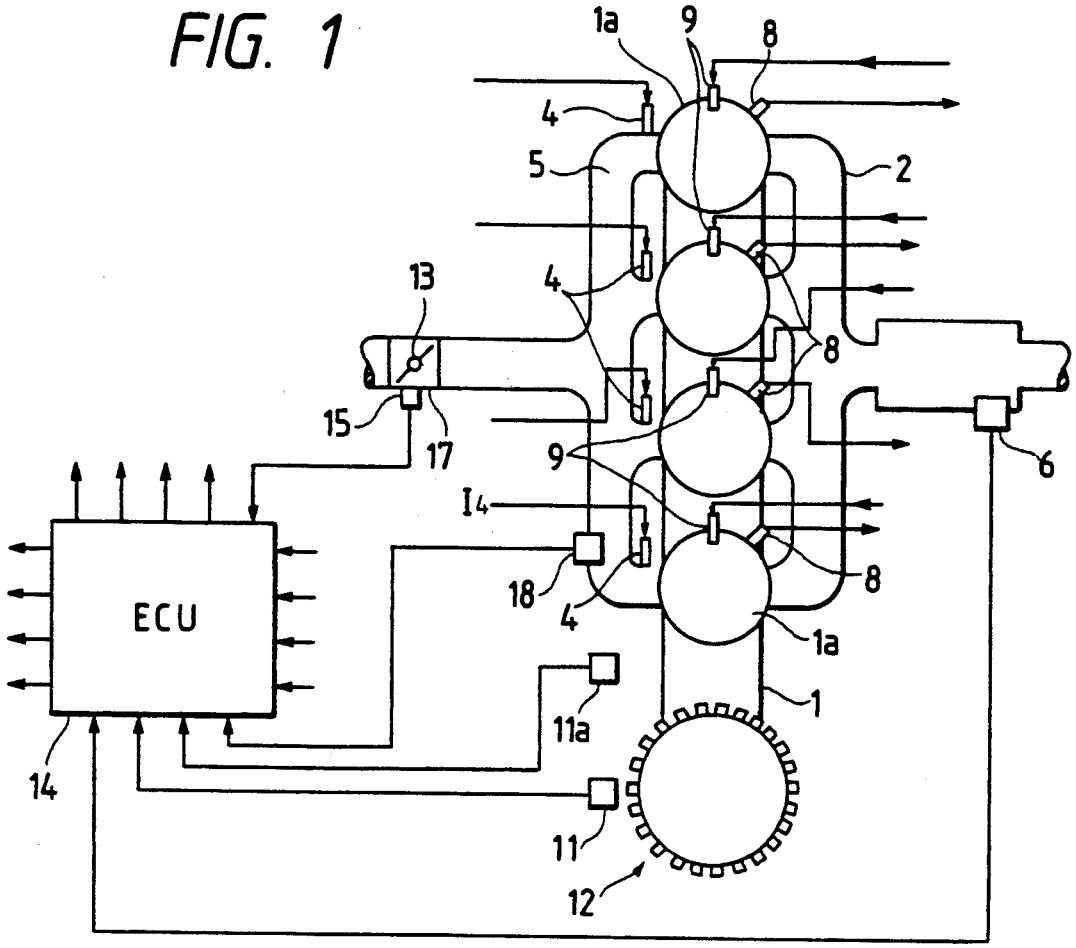
FIG. 1 is an explanatory diagram showing the arrangement of an engine control device, which constitutes one embodiment of this invention.

FIG. 1 is a diagram showing the arrangement of the embodiment of the invention. In FIG. 1, reference numeral 1 designates an engine body having four cylinders. In the cylinder head la of the engine body 1, a cylinder pressure sensor 8 and an ignition plug 9 are provided for each of the cylinders. The detecting parts of the cylinder pressure sensors 8 are exposed in the combustion chambers of the cylinders.

Injectors 4 are provided for suction ports which are communicated with the cylinders of the engine body 1. The suction ports are communicated through a suction manifold 5 with a throttle body 17. The throttle body 17 incorporates a throttle valve 13, and has a throttle opening sensor 15 for detecting a degree of opening of the throttle valve 3.

A suction air temperature sensor 18 for detecting a temperature of suction air is provided for the suction manifold 5. A crank angle sensor 11 for detecting crank angles predetermined for the cylinders is provided for a ring gear operated in association with the crank shaft (not shown) of the engine body 1. The crank angle sensor 11 outputs a reference position pulse for each crank angle reference position, and outputs a unitary angle pulse for each unitary angle (for instance 1°).

On the other hand, an air/fuel ratio sensor 6 is provided for the exhaust manifold 2 of the engine. In addition, a cylinder identifying crank angle sensor 11*a* is provided which operates in association with a cam shaft (not shown) in the cylinder head 1*a*.

Further in FIG. 1, reference numeral 14 designates control means; i.e., a control unit (hereinafter referred to as "an ECU", when applicable). The control unit 14 comprises: a micro-computer including, for instance, a CPU, RAM, ROM, and input-output interface; a cylinder pressure signal output circuit for amplifying the output signals of the cylinder pressure sensors 8; and a drive output signal circuit for driving the injectors and the ignition coils.

The outputs of the above-described air/fuel ratio sensor 6, cylinder sensors 8, crank angle sensors 11 and 11*a*, and throttle opening sensor 15 are applied to the ECU 14. The latter 14 performs predetermined operatios by using those outputs, and applies a fuel injection signal and an ignition signal to the injectors 4 and the ignition coils (not shown) and the ignition plugs through the drive circuit built in the ECU, thereby to control the fuel injection quantity and the ignition timing.

Figure 2:
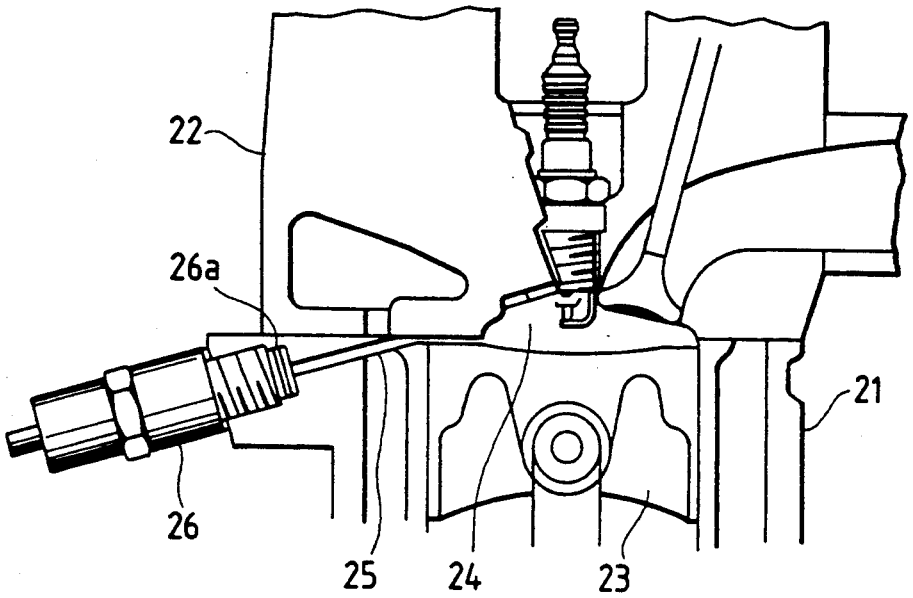
FIG. 2 is an explanatory diagram showing the installation of a cylinder pressure sensor of the engine control device shown in FIG. 2, which is adapted to detect a combustion chamber pressure.

The cylinder pressure sensor 8 for detecting the pressure in the combustion chamber is mounted on the engine as shown in FIG. 2. In FIG. 2, reference numeral 21 designates a cylinder block; 22, a cylinder head; 23, a piston, and 26, the aforementioned cylinder pressure sensor. The piston 23 and the cylinder pressure sensor 26 are engaged with the cylinder block 21.

The pressure detecting part 26*a* of the cylinder pressure sensor 26 is exposed in a pressure introducing channel 25 which is communicated with the combustion chamber 24. The sensor 26 outputs a cylinder pressure signal proportional to the pressure in the combustion chamber. The pressure detecting part 26*a* of the cylinder pressure sensor 26 is coupled to a pressure converting element (not shown), for instance, through silicon oil sealed in a metal diaphragm, to measure the pressure.

The pressure converting element is made up of a semiconductor sensor which is resistive against high temperature (300° C.) and high pressure (60 kg/cm$^2$). A strain gauge, which is formed by implanting impurities such as boron into a monocrystal silicon layer formed on a silicon oxide layer, is employed to convert a pressure applied thereto through the silicon oil into an amount of strain, to measure it. In this connection, a piezo electric element may be employed as the cylinder pressure sensor.

Figure 3:
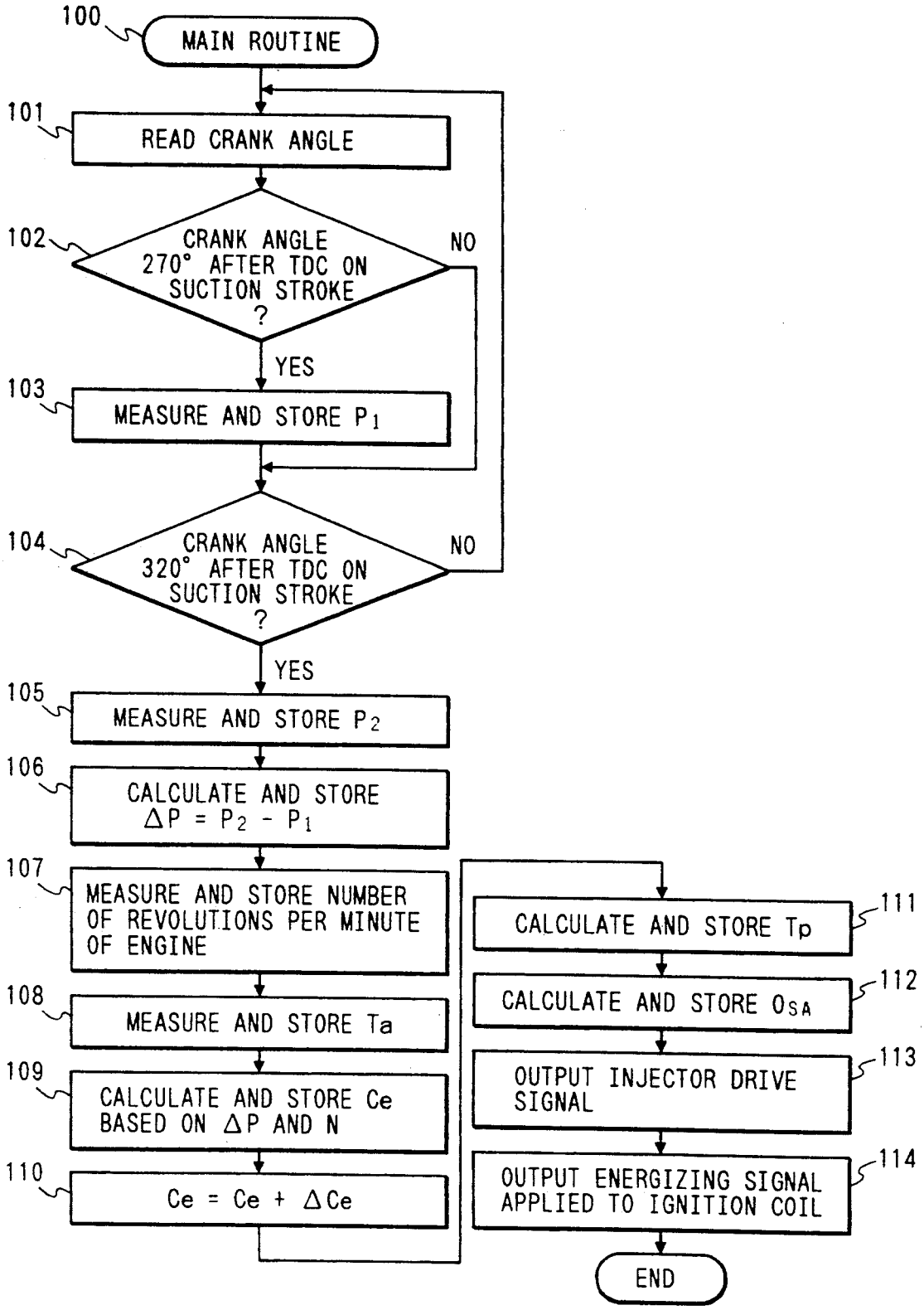
FIG. 3 is a flow chart of a main routine for a description of the operations of the engine control device and an engine control method according to the invention.
Figure 4:
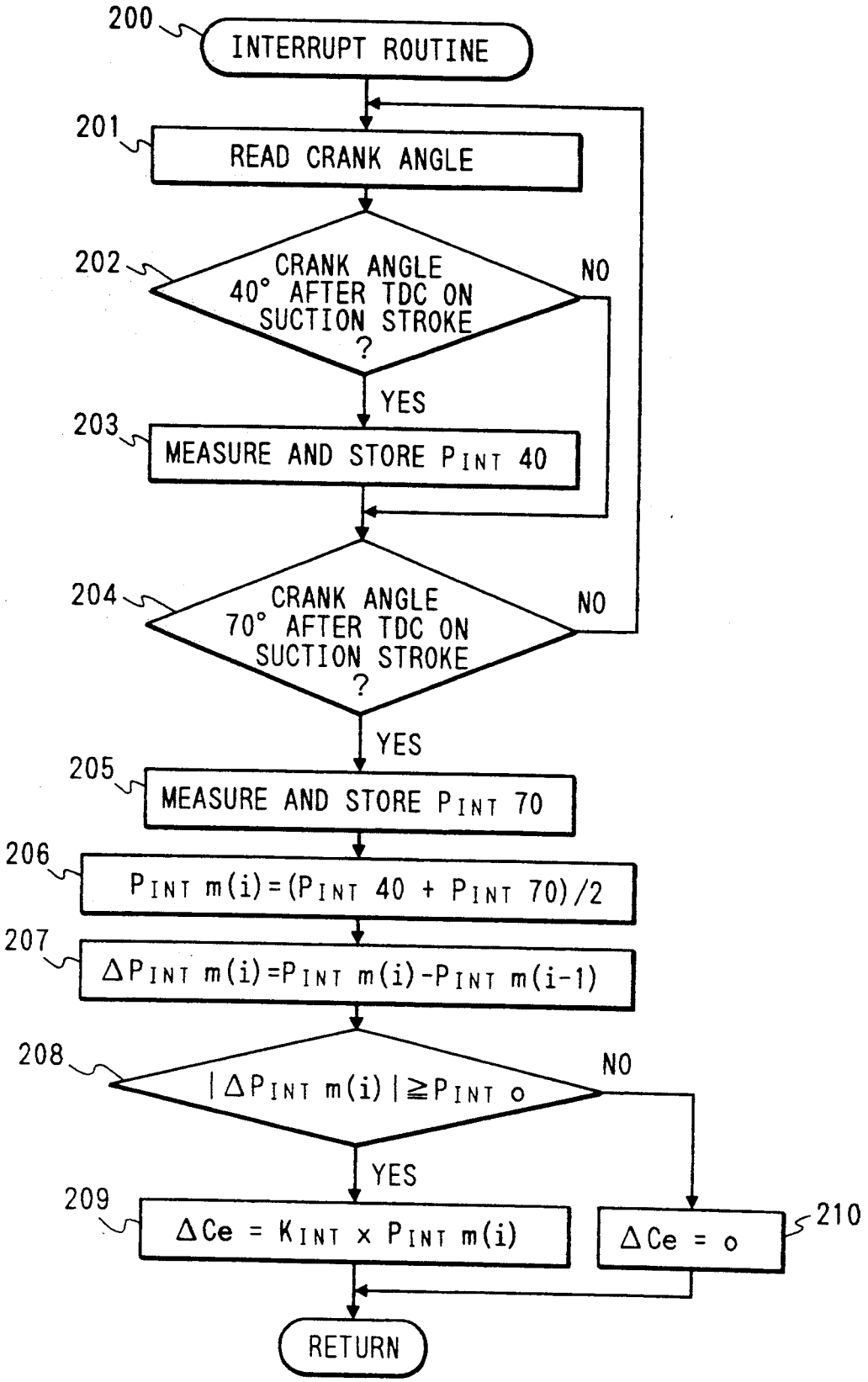
FIG. 4 is a flow chart of a crank-angle-synchronized interrupt routine for a description of the operations of the engine control device and the engine control method according to the invention.
Figure 5:
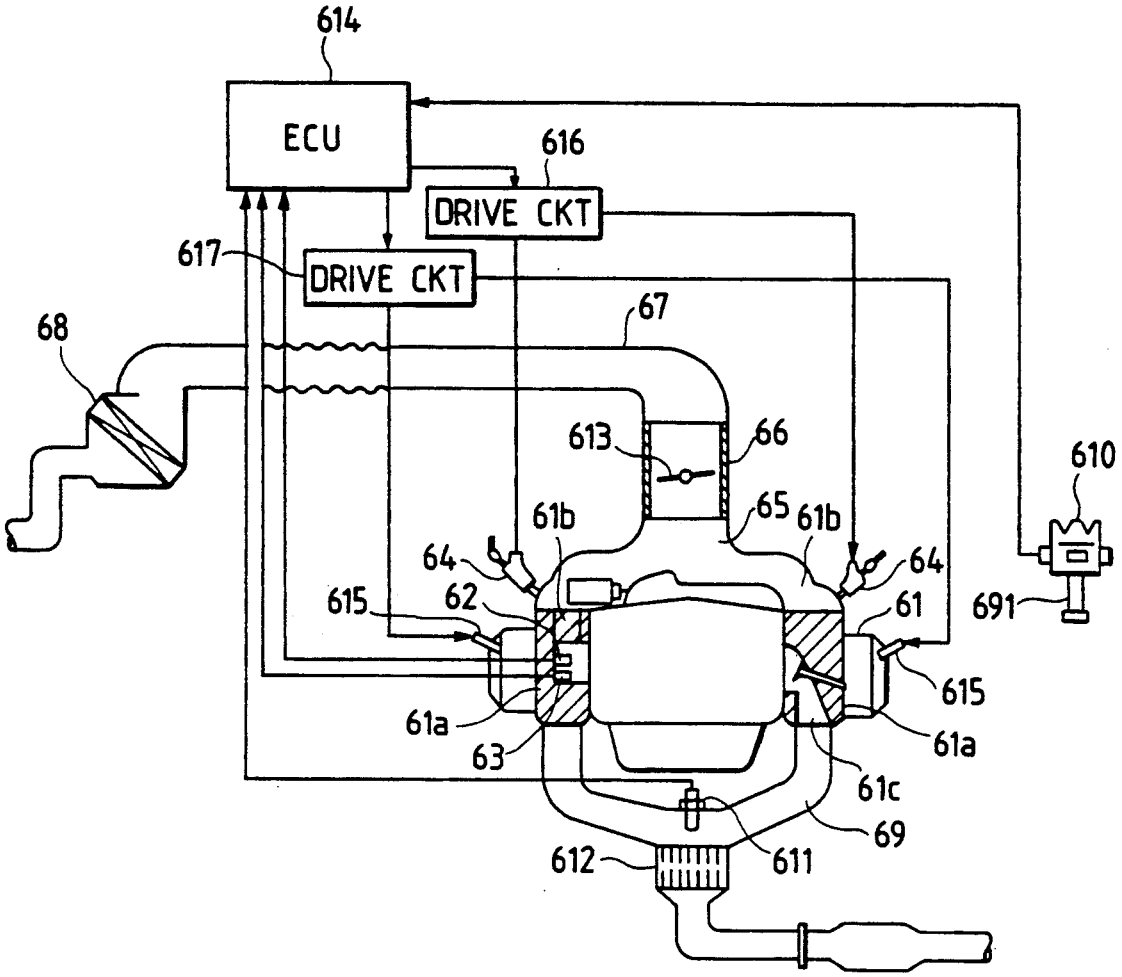
FIG. 5 is an explanatory diagram showing the arrangement of a conventional engine control device.
Figure 6:
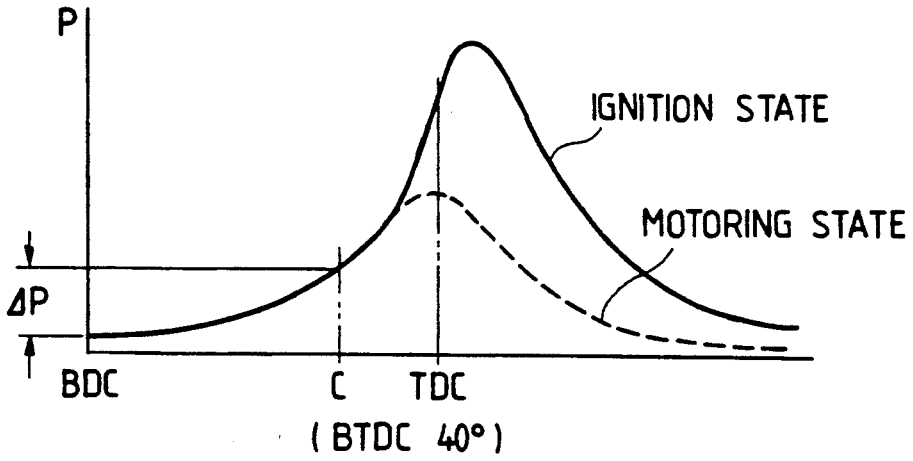
FIG. 6 is a waveform diagram showing cylinder pressure signals in the conventional engine control device.
Figure 7:
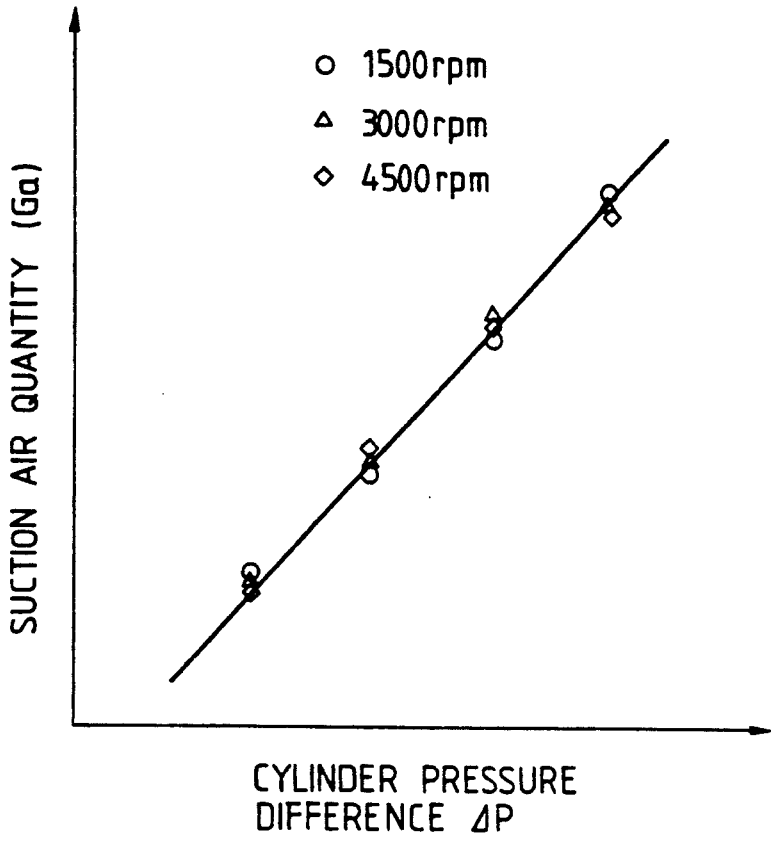
FIG. 7 is a graphical representation showing charged air quantities with cylinder pressure differences in the conventional engine control device.

The operations of the ECU 14 will be described with reference to flow charts shown in FIGS. 3 and 4. FIG. 3 shows a main routine for the ECU 14, and FIG. 4 shows a crank-angle-synchronized interrupt routine. The ROM in the ECU 14 stores a program which is so designed that, during the implement of the main routine shown in FIG. 3, the crank-angle-synchronized interrupt routine shown in FIG. 4 is effected at predetermined crank angle intervals.

First, the operations according to the main routine will be described with reference to FIG. 3. For simplification in description, the operations will be described with reference to the case where the engine has only one cylinder. In the case where the engine has a plurality of cylinders, a cylinder identifying operation is additionally carried out by using the output signals of the crank angle sensor 11*a*, and for each of the cylinders the operations are performed which are the same as those described hereinafter.

Upon start of the main routine, in Step 101 a crank angle is read from the output signal of the crank angle sensor 11. In the next Step 102, it is determined whether or not the crank angle thus read is 270° after TDC (top dead center) on the suction stroke. When the result of determination is "No"; that is, when it is determined that the crank angle is not 270° after TDC, then Step 104 is effected. When the result of determination is "Yes"; that is, when it is determined that the crank angle is 270° after TDC, then Step 103 is effected. The output pressure signal of first measuring means, namely, the cylinder pressure sensor 8 is measured as a cylinder pressure value P1 at 270° after TDC on the suction stroke, and stored in the RAM.

In Step 104, it is determined whether or not the current crank angle is 320° after TDC. When the crank angle is in a range of from 270° after TDC to 320° after TDC on the suction stroke, the polytropic exponent is substantially constant, and the change in cylinder pressure corresponds to a suction air quantity. In this case, 270° after TDC and 320° after TDC are selected as predetermined crank angles, by way of example.

When, in Step 104, the result of determination is "No", then Step 101 is effected again, and the above-described operations are carried out all over again. When, in Step 104, the result of determination is "Yes", then Step 105 is effected. In Step 105, the output pressure signal of the cylinder pressure sensor 8 is measured as a cylinder pressure value P2 at 320° after TDC on the suction stroke, and stored in the RAM of the ECU 14.

In the following Step 106, the difference ΔP between the two cylinder pressure values P1 and P2 (ΔP=P2−P1) is calculated, and stored in the RAM. In Step 107, the speed (the number of revolutions per minute) N of the engine is read from the output signal of the crank angle sensor 11, and stored in the RAM. In Step 108, the temperature $T_a$ of gas sucked newly into the engine is read from the output signal of the suction temperature sensor 18, and stored.

In Step 109, charging efficiency calculating means in the ECU 14 calculates according to the following Equation (3) the charging efficiency $C_e$ which has been obtained in advance through experiments by using the cylinder pressure difference ΔP and the engine speed N so that a predetermined air/fuel ratio is established. The charging efficiency $C_e$ thus calculated is stored in the RAM.

$$C_e = C_{eo} \times (a \times \Delta P / \Delta P_o + b) \times K_s \quad (3)$$

where a and b are the coefficients which have been obtained in advance by using the cylinder pressure difference ΔP and the engine speed N so that a predetermined air/fuel ratio is established (for instance a =1.109, and b=−0.108, $\Delta P_o$ and $C_{eo}$ are the table values which have been determined with respect to the engine speed in advance, and $K_s$ is the correcting coefficient which is used to correct the charging coefficient $C_e$ with the environmental conditions or warming up conditions of the engine detected, for instance, from the new gas temperature $T_a$.

Thereafter, in Step 110, a correcting charging efficiency $\Delta C_s$ which is calculated and stored in a timer routine (described later with reference to FIG. 4 in detail) is read And the above-described charging efficiency $C_e$ is corrected according to the following Equation (4), and stored.

$$C_e = C_e + \Delta C_e \quad (4)$$

In step 111, the charging efficiency $C_e$ thus corrected is used to calculate a fuel injection quantity $T_p$ according to the following Equation (5). The fuel injection quantity thus calculated is also stored.

$$T_p = K_i \times C_e \times K_{af} \times K_e \quad (5)$$

where $K_i$ is the fuel discharge quantity converting coefficient of the injector which is used to convert a charging efficiency $C_e$ into a fuel injection quantity; $K_{af}$ is the air/fuel ratio correcting coefficient; and $K_e$ is a correcting coefficient such as an acceleration correcting coefficient or an air/fuel ratio feedback coefficient for correcting an lo air/fuel ratio according to the output of the air/fuel ratio sensor 6.

In Step 112, ignition timing $\theta_{SA}$ is obtained from the ROM by mapping with the corrected charging efficiency $C_e$ and the engine speed N. Thereafter, Step 113 is effected. In Step 113, the fuel injection quantity $T_p$ obtained in Step 111 is used to output an injector drive signal to drive the injector 4. Next, in Step 114, an ignition timing setting operation is carried out according to the ignition timing θ obtained in Step 112, so that an energizing signal is applied to the ignition coil.

Now, the operations in the crank-angle-synchronized interrupt routine will be described with reference to FIG. 4. Upon start of the interrupt routine 200, in Step 201 a crank angle is read from the output signal of the crank angle sensor 11.

In the following Step 202, it is determined whether or not the current crank angle is 40° after TDC on the suction stroke. When the result of determination is "No", then Step 204 is effected. When it is "No", then Step 203 is effected. In Step 203, the output pressure signal of the cylinder pressure sensor 8 is measured and stored as a cylinder pressure value $P_{INT}40$ at 40° after TDC on the suction stroke.

In Step 204, it is determined whether or not the current crank angle is 70° after TDC on the suction stroke. When the result of determination is "No", then Step 201 is effected again, so that the above-described operations are carried out all over again. When, in Step 204, the result of determination is "Yes", then Step 205 is effected. In Step 205, the output signal of the cylinder pressure sensor 8 is measured and stored as a cylinder pressure value $P_{INT}70$ at 70° after TDC on the suction stroke.

Thereafter, Step 206 is effected. In Step 206, the values $P_{INT}40$ and $P_{INT}70$ stored in Steps 203 and 205 are used; that is, an average cylinder pressure $P_{INT}m(i)$ on the suction stroke of the i-th cycle is calculated according to the following Equation (6):

$$P_{INT}m(i) = (P_{INT}40 + P_{INT}70)/2 \quad (6)$$

Next, in Step 207, the difference $\Delta P_{INT}$ m(i) between the average cylinder pressures on the suction stroke of the (i−1)-th and i-th cycles of one and the same cylinder is calculated according to the following Equation (7):

$$\Delta P_{INT}m(i) = P_{INT}m(i) - P_{INT}m(i-1) \quad (7)$$

Thereafter, in Step 208, it is determined whether or not the absolute value of the variation $\Delta P_{INT}m(i)$ in average cylinder pressure on the suction stroke is equal to or larger than a predetermined value $\Delta P_{INT}o$. When the result of determination is "Yes", then Step 209 is effected. In Step 209, the correcting charging coefficient $\Delta C_e$ is calculated according to the following Equation (8) and stored.

$$\Delta C_e = K_{INT} \times \Delta P_{INT}\, m(i) \quad (8)$$

where $K_{INT}$ is the converting coefficient which is used to convert the data $\Delta P_{INT}$ m(i) into a charging efficiency variation $\Delta C_e$ which has been obtained through experiments according to the variation in average cylinder pressure on the suction stroke so that a predetermined air/fuel ratio is established, and which is given by a table concerning the engine speed N in advance.

When, in Step 208, the result of determination is "No", then Step 210 is effected. In Step 210, the interrupt routine is ended with $\Delta C_e = 0$.

In the above-described routine, the two cylinder pressures at 40° and 70° after TDC on the suction stroke are averaged to obtain the average cylinder pressure on the suction stroke, by way of example. However, the average cylinder pressure on the suction stroke may be obtained as follows: A cylinder pressure signal is measured at intervals of a crank angle of one degree (1°) on the suction stroke, and the cylinder pressure signals thus measured are averaged.

In the above-described embodiment, the crank angle sensors are mounted on the cam shaft and the crank shaft. However, the same effects can be obtained by modifying the embodiment in such a manner that the cam shaft is provided with a crank angle sensor which outputs a cylinder identifying signal and a 1° signal.

Furthermore, in the above-described embodiment, the transient state is determined from the absolute value of the variation $\Delta P_{INT}m(i)$ in the output value of the averaging means in the predetermined period of time. However, the same effects can be obtained by using, instead of the variation $\Delta P_{INT}$ m(i), the output of the throttle opening sensor for determination of the transient state.

If summarized, the engine control device of the invention is designed as follows: That is, when the engine is in steady state, the fundamental charging efficiency $C_e$ of the suction air quantity of the engine is calculated according to the difference $\Delta P$ between the cylinder pressures measured in synchronization with two crank angles on the compression stroke, at least one cylinder pressure $P_{INT}$ i is measured in synchronization with a crank angle on the suction stroke, the cylinder pressures $P_{INT}$i on the suction stroke are averaged, the correcting charging efficiency $\Delta C_e$ is calculated according to the variation $\Delta P_{INT}m(i)$ in the output value $P_{INT}m(i)$ of the averaging means in the predetermined period of time, and when the absolute value of the variation $\Delta P_{INT}m(i)$ is equal to or larger than the predetermined value, the fuel injection quantity and the ignition timing are controlled according to the value which is obtained by adding the correcting charging efficiency $\Delta C_e$ to the fundamental charging efficiency $C_e$. Hence, the suction air quantity can be detected without delay, being free from the effects of noises or spitting. Thus, not only when the engine is in steady state, but also when it is in transient state, the fuel injection quantity and the ignition timing can be controlled with high accuracy.

As was described above, the engine control device of the present invention is designed as follows: The first measuring means measures the difference between cylinder pressures detected in synchronization with two crank angles o the compression stroke, the charging efficiency calculating means calculates the fundamental charging efficiency for the suction air quantity of the engine according to the cylinder pressure difference thus measured, the second measuring means measures cylinder pressures in synchronization with crank angles on the suction stroke, the averaging means averages the cylinder pressures to obtain an average value, the correcting charging efficiency calculating means calculates a correcting charging efficiency according to the variation in the average value in the predetermined period of time, and the fuel injection quantity and the ignition timing are corrected with the correcting charging efficiency thus calculated. Hence, it is unnecessary for the device to employ an expensive air flow meter. With the cylinder pressure sensors and the crank angle sensor, the quantities of air charged into the cylinders are detected without delay. Not only when the engine is in steady state, but also when it is in transient state, the air/fuel ratio and the ignition timing can be controlled with high accuracy. More specifically, the engine can be controlled with a most suitable air/fuel ratio so that the exhaust gas purifying efficiency is maintained high at all times. Furthermore, the difficulty can be eliminated that the engine is lowered in drive characteristic by the occurrence of misfiring or knocking when the engine is in transient state.

In the engine control method of the present invention, when the engine is in steady state, the difference between cylinder pressures measured in synchronization with two predetermined cranks angles is utilized to calculate the fundamental charging efficiency for the suction air quantity of the engine, at least one cylinder pressure is measured in synchronization with a crank angle on the suction stroke, the cylinder pressures thus measured on the suction stroke are averaged to obtain an average value, the correcting charging efficiency is calculated according to the variation in the average value in a predetermined period of time, and when the absolute value of the variation is equal to or larger than the predetermined value, the fuel injection quantity and the ignition timing are corrected by using the value which is obtained by adding the correcting charging efficiency to the fundamental charging efficiency. Hence, the suction air quantity can be detected without delay, being free from the effects of noises or spitting. Thus, not only when the engine is in steady state, but also when it is in transient state, the fuel injection quantity and the ignition timing can be controlled with high accuracy, and the engine is maintained high in drive characteristic.

What is claimed is:

1. An engine control device comprising:

cylinder pressure sensors for detecting combustion chamber pressures of a multiple cylinder engine;

a crank angle sensor for producing a cylinder identifying signal and a crank angle signal in synchronization with rotation of said multiple cylinder engine;

first pressure measuring means for measuring combustion chamber pressures of said multiple cylinder engine on a compression stroke, in synchronization with said crank angle signal produced by said crank angle sensor;

charging efficiency calculating means for calculating a fundamental charging efficiency of said multiple cylinder engine according to said combustion chamber pressures measured by said first pressure measuring means;

state detecting means for detecting a state of said multiple cylinder engine whether said multiple cylinder engine is in acceleration state or in deceleration state from at least one of outputs of said cylinder pressure sensors and a throttle opening sensor;

second pressure measuring means for measuring at least one combustion chamber pressure in synchronization with a crank angle on a suction stroke;

averaging means for averaging combustion chamber pressures measured by said second pressure measuring means to provide an average value;

correcting charging efficiency calculating means for calculating a correcting charging efficiency according to a variation in said average value provided in a predetermined period of time; and control means for correcting a fuel injection quantity and ignition timing of said multiple cylinder engine according to said correcting charging efficiency when said state detecting means detects that said multiple cylinder engine is in acceleration state or in deceleration state.

2. An engine control method comprising the steps of:

detecting combustion chamber pressures of a multiple cylinder engine by cylinder pressure sensors;

generating a cylinder identifying signal and a crank angle signal in synchronization with rotation of said multiple cylinder engine by a crank angle sensor;

measuring combustion chamber pressures of said multiple cylinder engine on a compression stroke, in synchronization with said crank angle signal by first pressure measuring means;

calculating a fundamental charging efficiency of said multiple cylinder engine according to said combustion chamber pressures which is measured by said first pressure measuring means by charging efficiency calculating means:

detecting a state of said multiple cylinder engine is in acceleration or in deceleration state from at least one of outputs of said cylinder pressure sensors and a throttle opening sensor by state detecting means;

measuring at least one combustion chamber pressure in synchronization with a crank angle on a suction stroke by second pressure measuring means;

averaging combustion chamber pressures measured by said second pressure measuring means, to provide an average value by averaging means;

calculating a correcting charging efficiency according to a variation in said average value provided by said averaging means in a predetermined period of time by correcting charging efficiency calculating means; and correcting a fuel injection quantity and ignition timing of said multiple cylinder engine according to said correcting charging efficiency when said state detecting means detects whether said multiple cylinder engine is in acceleration state or in deceleration state by control means.

* * * * *